US009700483B2

(12) United States Patent
Vinokur et al.

(10) Patent No.: US 9,700,483 B2
(45) Date of Patent: Jul. 11, 2017

(54) SOAKING BASIN HAVING MAGNETIC JET

(71) Applicant: FOOTSIEBATH, LLC, Beverly Hills, CA (US)

(72) Inventors: Sasha Vinokur, Los Angeles, CA (US); Genya Vinokur, Los Angeles, CA (US); Michael Vinokur, Los Angeles, CA (US)

(73) Assignee: Footsiebath, LLC, Beverly Hills, CA (US)

( * ) Notice: Subject to any disclaimer, the term of this patent is extended or adjusted under 35 U.S.C. 154(b) by 147 days.

(21) Appl. No.: 14/622,584

(22) Filed: Feb. 13, 2015

(65) Prior Publication Data

US 2015/0297446 A1 Oct. 22, 2015

Related U.S. Application Data

(60) Provisional application No. 61/940,305, filed on Feb. 14, 2014.

(51) Int. Cl.

| | |
|---|---|
| ***A47K 3/022*** | (2006.01) |
| ***A61H 33/00*** | (2006.01) |
| ***A61H 35/00*** | (2006.01) |
| ***A45D 29/00*** | (2006.01) |

(52) U.S. Cl.

CPC ..... *A61H 33/0087* (2013.01); *A45D 29/00* (2013.01); *A61H 33/0091* (2013.01); *A61H 35/00* (2013.01); *A61H 35/006* (2013.01); *A61H 2201/0207* (2013.01); *A61H 2201/0228* (2013.01); *A61H 2201/0235* (2013.01); *A61H 2201/1215* (2013.01); *A61H 2205/065* (2013.01)

(58) Field of Classification Search

CPC ..... A61H 35/006
USPC ..... 4/619–660
See application file for complete search history.

(56) References Cited

U.S. PATENT DOCUMENTS

| | | | | |
|---|---|---|---|---|
| 430,195 | A | 6/1890 | Reimers | |
| 1,338,486 | A * | 4/1920 | Burdick | A47L 17/02 211/130.1 |
| 2,904,037 | A * | 9/1959 | Cassidy | A61H 33/6089 392/458 |
| 3,367,325 | A * | 2/1968 | O'Keefe | A61H 33/025 4/559 |
| 3,481,586 | A * | 12/1969 | Roberts | F04D 13/026 366/264 |
| 3,648,690 | A * | 3/1972 | Miller | A61H 33/025 4/583 |
| 4,010,498 | A * | 3/1977 | Jablonski | A61H 33/6063 4/569 |
| 4,513,735 | A * | 4/1985 | Friedson | A61H 35/006 601/15 |
| 4,632,115 | A * | 12/1986 | Bernardini | A61F 7/00 607/86 |
| 5,886,323 | A * | 3/1999 | Hivale | A45D 29/00 132/73.5 |

(Continued)

*Primary Examiner* — Lori Baker
(74) *Attorney, Agent, or Firm* — Tsircou Law, PC

(57) ABSTRACT

A soaking basin is provided having a magnetic jet assembly positioned to provide a therapeutic liquid circulation within the basin. The magnetic jet includes an impeller assembly and a drive assembly. The impeller assembly operatively coupled to the magnetic drive assembly only via magnetic attraction, such that a basin wall and a disposable liner are disposed between the impeller assembly and the magnetic drive assembly.

20 Claims, 7 Drawing Sheets

(56) References Cited

U.S. PATENT DOCUMENTS

| | | | | |
|---|---|---|---|---|
| 6,085,367 | A * | 7/2000 | Guiste | A47K 3/002 4/546 |
| 6,708,961 | B2 * | 3/2004 | Ferber | A61H 33/025 261/122.1 |
| 6,772,800 | B1 * | 8/2004 | Garcia | A47K 3/022 141/2 |
| 6,886,191 | B2 * | 5/2005 | Zolotnik | A61H 35/006 4/619 |
| 8,763,174 | B2 * | 7/2014 | Vinokur | C23C 16/4412 4/655 |
| 2003/0074730 | A1 * | 4/2003 | Ferber | A47K 3/022 4/622 |
| 2003/0192871 | A1 * | 10/2003 | Glucksman | A61H 33/04 219/432 |
| 2005/0188458 | A1 * | 9/2005 | Dickstein | A47K 3/002 4/583 |
| 2006/0210412 | A1 * | 9/2006 | Lawyer | F04D 29/628 417/420 |
| 2006/0242760 | A1 | 11/2006 | Chao | |
| 2013/0167295 | A1 | 7/2013 | Vinokur et al. | |

* cited by examiner

SOAKING BASIN HAVING MAGNETIC JET

CROSS REFERENCE TO RELATED APPLICATION

This application claims the benefit of U.S. Provisional Application No. 61/940,305, filed Feb. 14, 2014, which is herein incorporated by reference.

FIELD OF THE INVENTION

The present invention relates generally to soaking basins and, more particularly, to a soaking basin further having magnetic jet.

BACKGROUND OF THE INVENTION

While receiving a pedicure or a manicure at beauty salons, clients customarily have their hand and feet soaked in a basin of warm liquid. Soaking softens the skin and nails and has many other therapeutic benefits that include stimulating circulation of the blood and otherwise alleviating fatigue. Consequently, soaking is a particularly enjoyable part of having a manicure or pedicure.

In a salon setting, a soaking basin can be used by dozens of clients in a single day. So, hygienic practices regarding use of the basins are an important consideration. It is common and often required, that the basin is emptied and cleaned between uses. However, such repeated cleaning can reduce the life of the basin and can be time consuming. Instead, to cut down on repeated cleanings while promoting hygiene, many salons use makeshift liners such as plastic sacks, particularly those commonly used for groceries. Although generally effective, such plastic sacks lack sufficient rigidity to remain in place. Thus, leaking can be problem and, even if properly secured, wet sacks can feel odd against the client's skin. In addition, use of plastic bags lack esthetic appeal.

In current approaches, it is typically required that the technician lift the entire soaking basin filled with liquid to discard the liquid in between uses. Many such soaking basins include electrical components such as heating, vibration, and air circulation systems, adding to the weight of the soaking basin. Thus, such basins can be relatively heavy and awkward to lift.

It should, therefore, be appreciated that there exists a need for a soaking basin having a disposable liner that provides a therapeutic soak and is cost-effective to manufacture. The present invention fulfills this need and others.

SUMMARY OF THE INVENTION

Briefly, and in general terms, a portable soaking basin is provided having a base unit, a disposable liner, and a frame nested between the base unit and the disposable liner. The base unit having a basin base and a peripheral basin wall adjacent to and projecting upwardly from the basin base and a basin floor above the basin base as to create a basin cavity. The soaking basin also has a magnetic jet assembly positioned to provide a therapeutic liquid circulation within the basin. The magnetic jet includes an impeller assembly and a drive assembly. The impeller assembly is operatively coupled to the magnetic drive assembly only via magnetic attraction, wherein the basin floor is disposed between the impeller assembly and the magnetic drive assembly.

More specifically, by way of example and not limitation, the impeller assembly includes an impeller mounted for rotation within the impeller housing. The impeller has a cylindrical shaft, a planar base centered on the shaft, and a plurality of fins extending outwardly from the shaft. The plurality of fins are disposed on the top side of the planar base. The impeller further includes a magnetic component disposed on a bottom of the impeller.

In an exemplary embodiment, the impeller housing defines at least one input port in an upper portion thereof, proximate to the shaft. The at least one input port is disposed above the proximal region of the impeller and circumscribe the shaft. The housing also defines an output port distally spaced from the distal edge of the impeller. The impeller is configured to draw liquid into the impeller housing via the input ports and expel accelerated liquid out of the housing via the output port, creating a jet of liquid that provides therapeutic circulation of liquid. The output port may also be defined by a projection of the housing. The projection may be oriented tangentially to the impeller to guide liquid out of the interior of the housing, when in use. The output port may also have a height greater than the height of the impeller.

The frame enables easy removal of the liner from the base unit, even when filled with liquid. In this manner, a user can remove the liner filled with liquid to pour out the liquid and discard the liner, after a treatment has been completed. Moreover, the basin is cost-effective to manufacture and use.

More specifically, in an exemplary embodiment, the base unit includes a base unit floor, a peripheral wall projecting upwardly therefrom, which combine to define a basin cavity for receiving the disposable liner and the frame, and a base compartment covered by the base unit floor. The liner and frame are configured to nest with the basin cavity. The base unit provides structural support to the soaking basin, allowing the liner to be particularly thin, e.g., 0.03-0.50 mm, without sacrificing the stability of the basin.

In a detailed aspect of an exemplary embodiment, the frame includes a lip support disposed adjacent to the lip of the liner, a pair of handles coupled to the lip support and configured to extend beyond the periphery of the peripheral wall of the base unit when the frame is nested therein, a base support coupled to the lip support and disposed below the floor of the liner, and a side support coupled between the lip support and the base support.

In another detailed aspect of an exemplary embodiment, the lip support circumscribes the lip of the frame. The lip of the liner can further define a spout disposed between the handle of the frame to facilitate disposal of liquid within the liner.

In yet another detailed aspect of an exemplary embodiment, both the base unit and the liner define an elongate protrusion that nest together. The base support defines an opening to enable an elongate protrusion of the base unit to extend therebetween.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
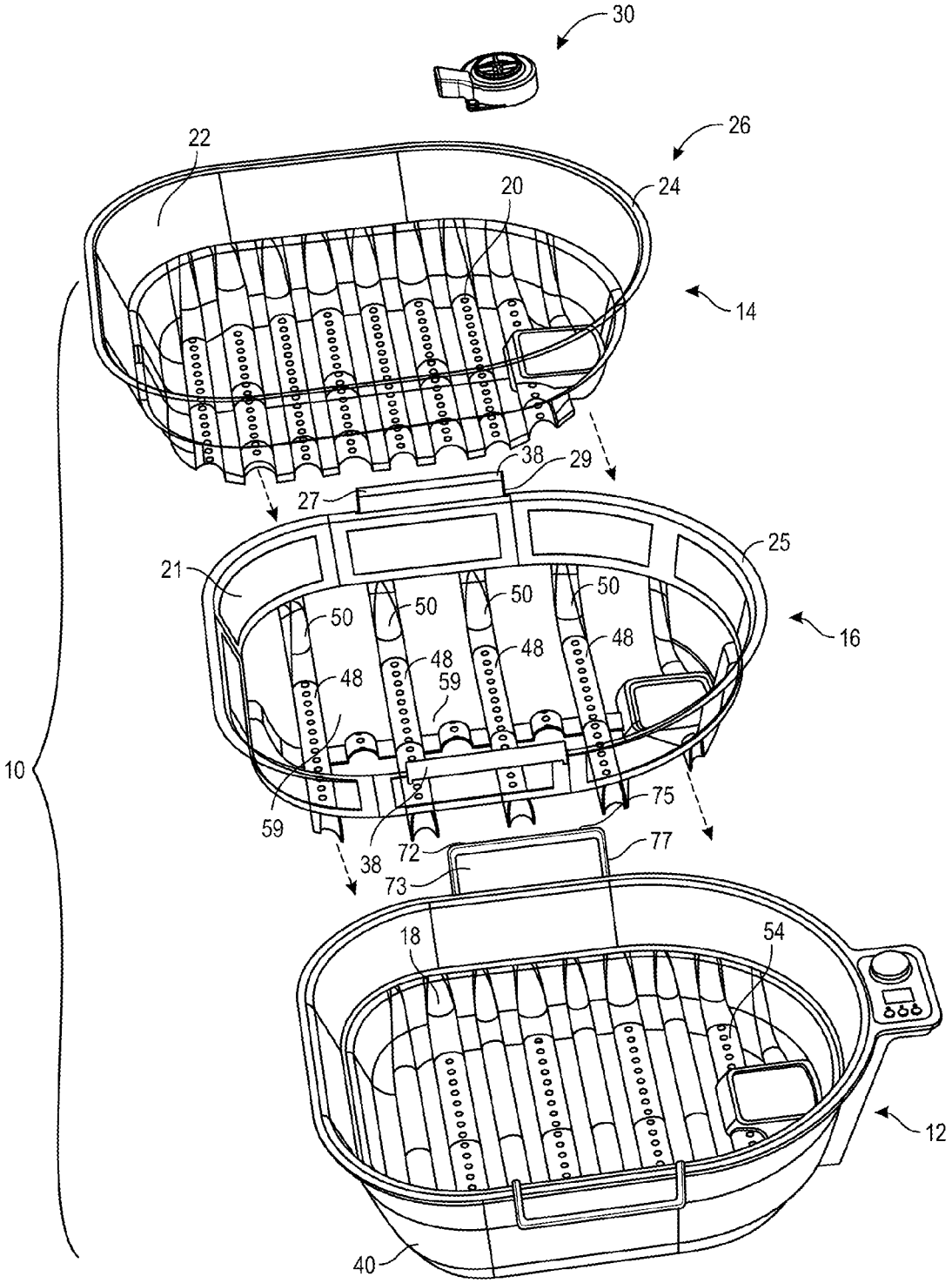
FIG. 1 is exploded perspective view of a portable soaking basin having a frame, an magnetic jet assembly, and a disposable liner in accordance with the invention.

Referring now to the drawings, and particularly FIG. 1, there is shown a portable soaking basin 10 having a base unit 12, a disposable liner 14, and a support frame 16 nested between the base unit 12 and the disposable liner 14. The soaking basin 10 further includes a magnetic jet assembly 28 (FIG. 5) positioned to provide a therapeutic liquid circulation within the basin. The magnetic jet includes an impeller assembly 30 and a magnetic drive assembly 32 (FIG. 2), wherein the impeller assembly 30 is operatively coupled to the magnetic drive assembly 32 only via magnetic attraction, wherein the basin floor is disposed between the impeller assembly 30 and the magnetic drive assembly 32.

Figure 2:
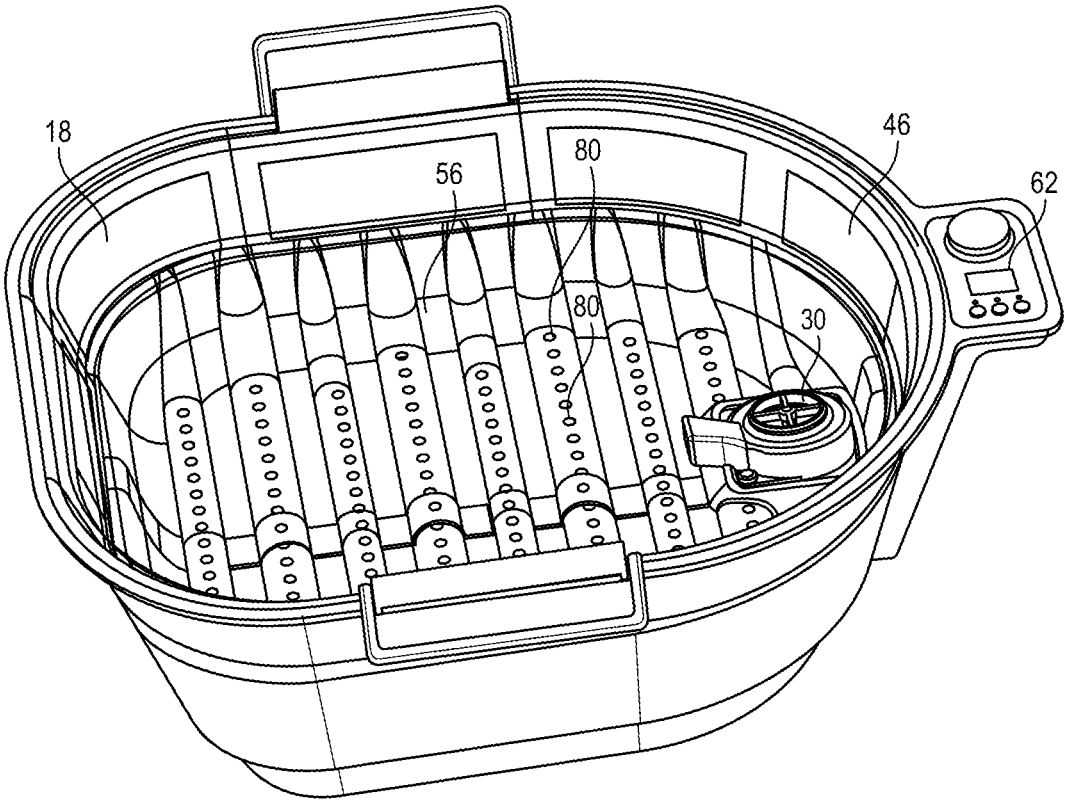
FIG. 2 is a top perspective view of the soaking basin of FIG. 1, depicting the magnetic jet assembly disposed within a basin.

With reference now to FIG. 2, the soaking basin 10 defines a peripheral wall 40 that is generally an oval cylindrical wall and a basin base 57 adjacent to the peripheral wall 40 and a basin floor 56 above the basin base 57 as to create a basin cavity 18 sized to receive a user's feet above the basin floor 56 and a base compartment 70 below the basin floor 56. The impeller assembly 30 of the magnetic jet assembly 28 (FIG. 5) is disposed along the basin floor 56 and proximate to a first end 46 of the soaking basin 10.

Figure 3:
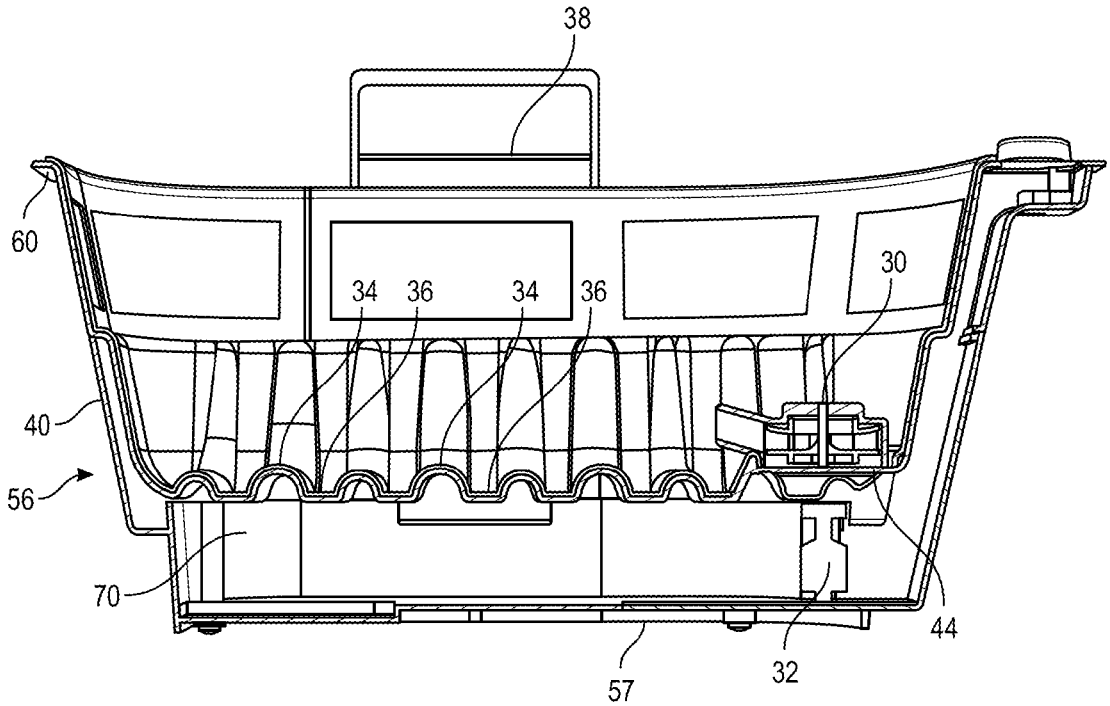
FIG. 3 is a cross-sectional view of the soaking basin of FIG. 1, depicting a magnetic impeller and a magnetic drive of the magnetic jet assembly.

With reference now to FIG. 3, the basin floor 56 includes a plurality of parallel ridges 34 that define recessed portions 36 therebetween. In this manner, therapeutic liquid can circulate below the user's feet, even when the user's feet are firmly placed on the basin floor 56. The impeller assembly 30 is disposed atop the basin floor 56 and is held in place via magnetic attraction to the magnetic drive assembly 32 disposed below the basin floor 56, within the base compartment 70 of the base unit 12 (FIG. 1). More particularly, the impeller assembly 30 is positioned atop a raised planar portion of floor (raised table 44). The raised table 44 positions the impeller assembly 30 elevated relative to the plurality of parallel ridges 34.

Figure 4:
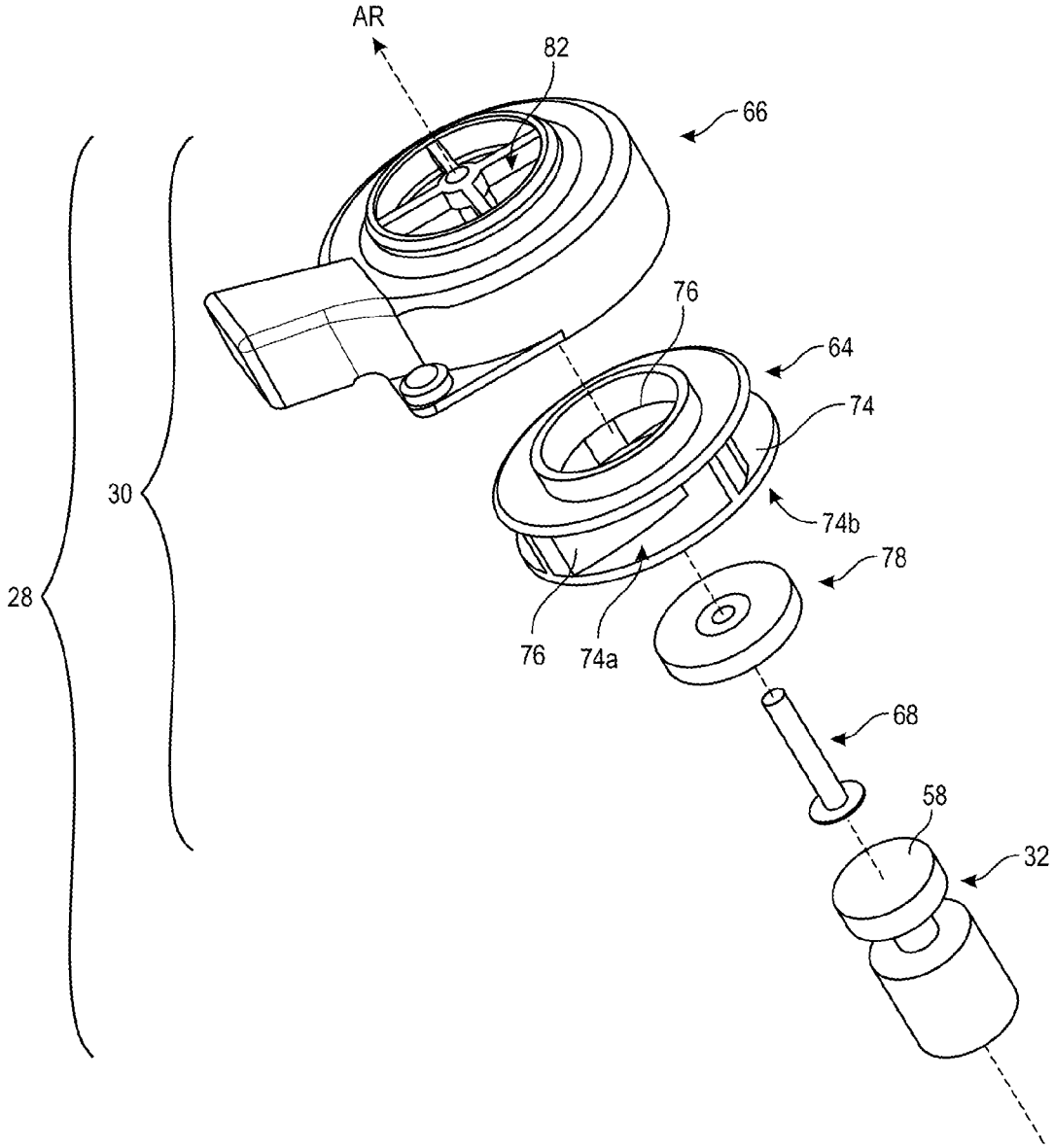
FIG. 4 is a partially exploded view of the magnetic jet assembly of the soaking basin of FIG. 1, depicting the magnetic impeller assembly having a housing, an impeller, and a shaft.
Figure 6:
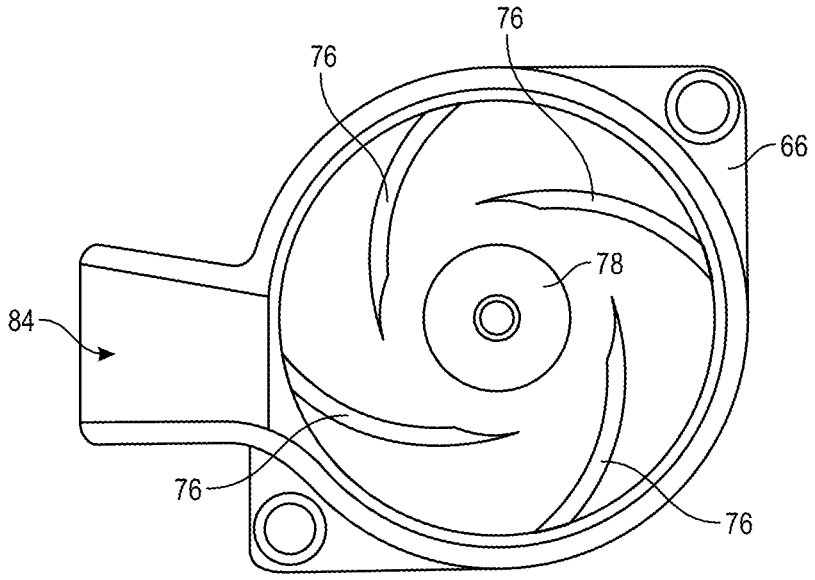
FIG. 6 is a top cross-sectional view of the impeller assembly of FIG. 5 along the section line A-A in FIG. 5.

With reference to FIG. 4, the impeller assembly 30 includes an impeller 64 mounted for rotation within an impeller housing 66 via a shaft 68. The shaft is affixed to the impeller housing 66, and it defines an axis of rotation (Ar) oriented transverse to the basin floor 56 (FIG. 3) and the raised table 44 (FIG. 3). The impeller 64 defines a cylindrical aperture for receiving the shaft 68. The impeller 64 includes a planar base 74 centered on the shaft 68 and a plurality of fins 76 that extend outwardly from the shaft 68. The planar base 74 includes a top side **74*a* and a bottom side 74*b*. The plurality of fins 76 are disposed on the top side 74*a* of the base 74 and are best seen in FIG. 6**.

The impeller 64 further has a magnetic component 78, which may be disk-shaped or comprising a plurality of magnetic components, that magnetically interact with the magnetic drive assembly 32. In the exemplary embodiment, the magnetic component 78 is disposed along the bottom side **74*b* of the planar base 74. The impeller housing 66 defines at least one input port 82 defined in an upper portion thereof, proximate to the shaft 68. In the exemplary embodiment, the impeller housing 66 includes a plurality of input ports 82 that are disposed above the proximal region of the impeller 64 and circumscribe the shaft 68. The impeller housing 66 also defines an output port 84 (FIG. 5) distally spaced from the distal edge of the impeller 64. The impeller 64 is configured to draw liquid into the impeller housing 66 via the input ports 82 and expel accelerated liquid out of the impeller housing 66 via the output port 84, creating a jet of liquid that provides therapeutic circulation of liquid. The output port 84 is defined by a projection 86 of the impeller housing 66. The projection 86 is oriented tangentially to the impeller 64 to guide liquid out of the impeller assembly 30, when in use. The output port 84 may have a height greater than the height of the impeller 64**.

Figure 5:
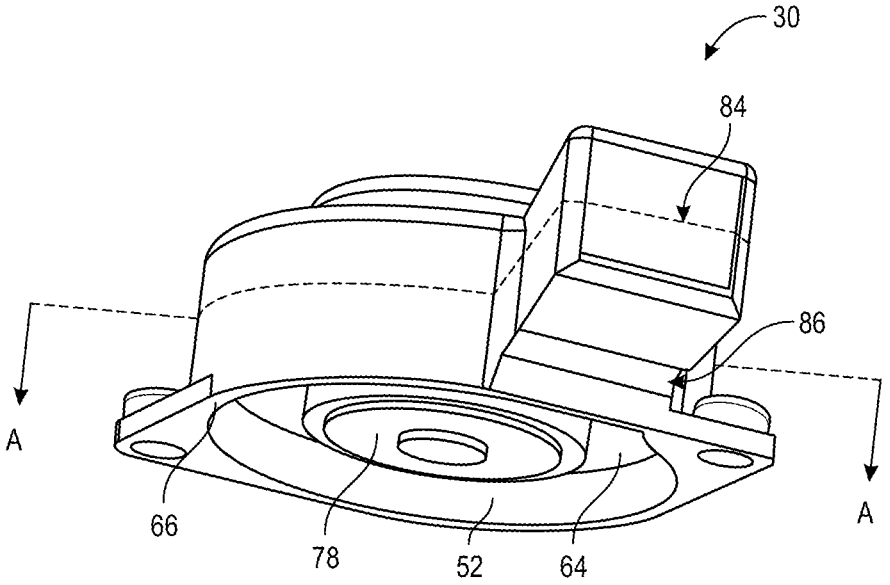
FIG. 5 is a bottom perspective view of the impeller assembly of the magnetic jet assembly of FIG. 4.

Referring to FIG. 5, the impeller housing 66 of the impeller assembly 30 defines a bottom opening 52 that has a greater diameter than the diameter of the impeller 64. The configuration of the impeller assembly 66, including the bottom opening 52 and output port 84 of the impeller housing 66, enables effective cleaning of the impeller assembly 30, between uses. The magnetic drive assembly 32 includes a planar disc 58 that is disposed below the impeller assembly 30. The planar disc 58 projects a magnetic field that magnetically attracts the impeller assembly 30, to secure the impeller assembly 30 in place. More particularly, the magnetic drive assembly 32 is an electro-magnet that generates the magnetic field to cause the impeller to spin about the axis of rotation (Ar), when in use.

The impeller 30 can be oriented by the user to have the output port 84 facing in any direction radially. For example, the output port can be directed toward the user's feet to provide flow of liquid directed towards the feet. Or, the output port can be oriented so that the flow of liquid creates a whirlpool effect.

With reference again to FIGS. 1-3, the support frame 16 enables easy removal of the disposable liner 14 from the base unit 12, even when filled with liquid. In this manner, a user can remove the disposable liner 14 filled with liquid to pour out the liquid and discard the disposable liner 14, after a treatment has been completed. Thus, the user need not lift the entire soaking basin 10 to pour out liquid. In addition, the user can use the support frame 16 to support a new liner while filling it with liquid, and to transport the filled liner to the base unit to service clients. Because stability of the soaking basin 10 during use is an important design consideration, the base unit 12 is configured to enable the disposable liner 14 and the frame 15 to nest within the basin cavity 18 in a stable manner, particularly during use.

The disposable liner 14 may have a pre-formed shape closely conforming to nest within the basin cavity 18 defined by the base unit 12. The disposable liner 14 includes a liner floor 20 and a peripheral wall 22, circumscribing the liner floor 20. The peripheral wall 22 terminates with a lip 24 disposed about the periphery of an upper portion 26 of the disposable liner 14. The lip 24 is generally horizontally oriented. The disposable liner 14 can further include a drain (not shown) on the liner floor 20. The drain can include a removable cap to enable the user to drain the disposable liner 14 once removed from the base unit 12. Since the disposable liner 14 is intended to be disposed after use, material cost for the disposable liner 14 is an important consideration. The disposable liner 14 is formed of liquid impermeable material such as plastic, e.g., polycarbonate or PET plastic. In the exemplary embodiment, the base unit 12 is configured to provide structural support to the soaking basin, allowing the liner to be particularly thin, e.g., 0.03-0.50 mm, without sacrificing stability. In the exemplary embodiment, the disposable liner 14 is about 0.30 mm.

The support frame 16 includes a peripheral wall 21 that terminates with a lip support 25 that circumscribes the upper portion 26 of the disposable liner 14 adjacent to the lip 24 of the disposable liner 14 to support the disposable liner 14, when the disposable liner 14 is nested therein. The lip 24 is generally horizontally oriented. The support frame 16 further includes a pair of handles 38 coupled to the lip support 25. The handles 38 extend beyond the peripheral wall 40 of the base unit 12 when the support frame 16 is nested therein. The handles 38 are generally u-shaped and are sized to allow a user insert their fingers through an opening 23 defined by the handle 38 to grasp an intermediate portion 27 of the handle 38. The handles 38 may be attached to the lip support 25 by spaced-apart portions 29.

The support frame 16 further includes base supports 48 disposed below and in contact with the liner floor 20 when the disposable line 14 is nested therein, to aid in supporting the disposable liner 14 in transport. The base supports 48 are disposed between the parallel ridges 34 of the soaking basin 10 within the recessed portions 36. In the exemplary embodiment, each base support 48 is attached to the peripheral wall 21 by side supports 50 on opposing ends of the base support 48. The support frame 16 defines a plurality of voids (e.g., openings 59) throughout such that the support frame 16 is incapable of holding the soaking solution apart from the disposable liner 14 and the openings 59 may be conformingly sized to receive the parallel ridges 34 of the disposable liner 14.

The support frame 16 is configured such that it is incapable of retaining liquid separate from the disposable liner 14. In the exemplary embodiment, the support frame 16 has a skeletal configuration formed of metal, providing stable support for the frame during transport; however, other materials, e.g., plastic, composite material and so on, can be used to in other embodiment that can provide sufficient structural stability for its intended purpose. In some embodiments, the frame may be formed of stainless steel in wire form, having a diameter of about 20 mils. In other embodiments, the frame can implement various combinations of support members and components, so long as sufficient structural stability is provided for the liner.

With reference again to FIG. 1, the base unit 12 further includes a pair of handles 72 coupled to the lip support. The handles 72 extend beyond the periphery of the peripheral wall 40 of the base unit 12. The handles 72 are generally u-shaped and are sized to allow a user insert their fingers through an opening 73 defined by the handle 72 to grasp an intermediate portion 75 of the handle 38. The handles 38 may be attached to the lip support 25 by spaced-apart portions 77. The base unit 12 also includes electronic components to provide heat, agitation, and/or air bubbles, as disclosed in applicant's U.S. application Ser. No. 11/382,548, filed Mar. 10, 2006, which is herein incorporated by reference, for all purposes.

In the exemplary embodiment, the base unit 12 is of unitary construction, including the peripheral wall 40 integrally attached to the base compartment 70, further to facilitate stable support for the soaking basin 10 while in use. In other embodiments, the base unit 12 can include a separate basin that rests upon a base that includes the base compartment 70. In further embodiments, a heating component, such as a heat sink plate, may be disposed between an inner bath and outer bath housing. In other embodiments, the base unit 12, the disposable liner 14, and the support frame 16 may have a plurality of traction bumps 80 along the corresponding parallel ridges 34 and recessed portions 36. In other embodiments, there is a controller unit 62 proximate to the first end 46 of the soaking basin 10 that controls the functions of the soaking basin 10, such as temperature control and water circulation.

Figure 7:
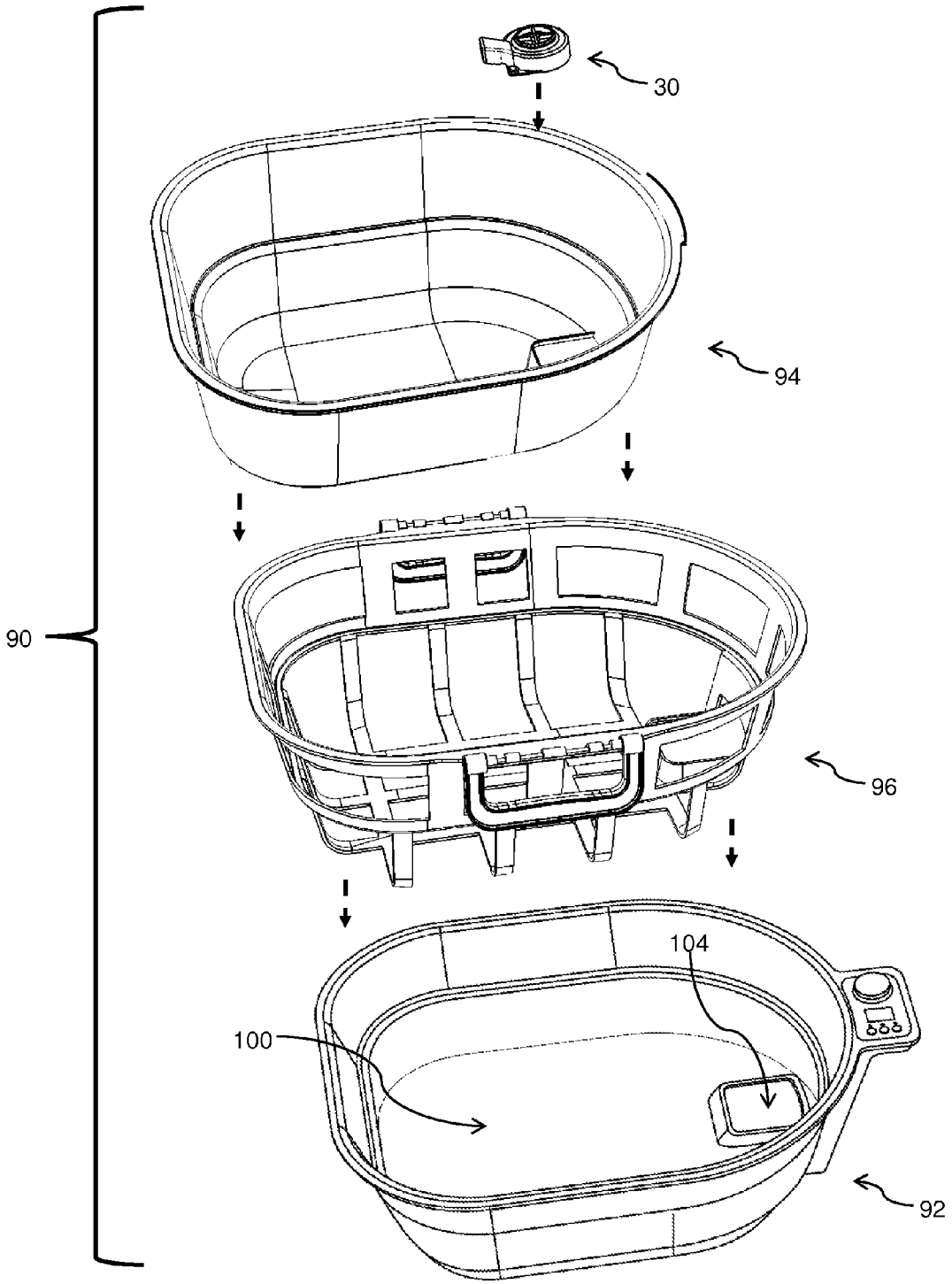
FIG. 7 is a top perspective view of another embodiment of the soaking basin having a frame, a magnetic jet assembly, and a disposable liner in accordance with the invention.

Referring now to FIG. 7, there is shown a soaking basin 90 having a base unit 92, a disposable liner 94, and a support frame 96 nested between the base unit 92 and the disposable liner 94. The soaking basin 90 further includes a magnetic jet assembly 28 (FIG. 5) positioned to provide a therapeutic liquid circulation within the basin 90 as described in the embodiments above. The floor 100 of the base unit 92 is substantially flat to facilitate the heating of the therapeutic liquid via the heating assembly 110 (FIG. 9).

The floor of the disposable liner 94 is similarly flat, and the support frame 96 is configured to fit snuggly between the disposable liner 94 and the support frame 96. The impeller assembly 30 is disposed atop the liner floor and the base unit floor 100 and is held in place via magnetic attraction to the magnetic drive assembly 32 disposed below the basin floor 100, within the base compartment 116 of the base unit 92 (FIG. 9). More particularly, the impeller assembly 30 is positioned atop a raised planar portion of floor (raised table 104). The raised table 104 positions the impeller assembly 30 elevated relative to the substantially flat basin floor 100. In this manner, the therapeutic liquid can be heated by the heating assembly 110 (FIG. 9).

Figure 8:
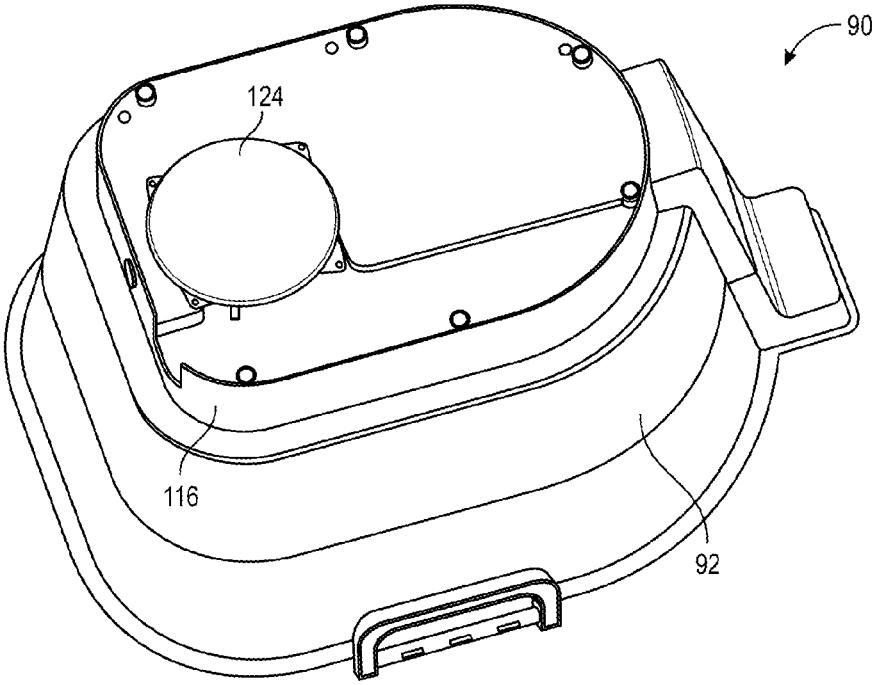
FIG. 8 is bottom perspective view of the soaking basin of FIG. 7, depicting the housing of the heating assembly of the soaking basin.
Figure 9:
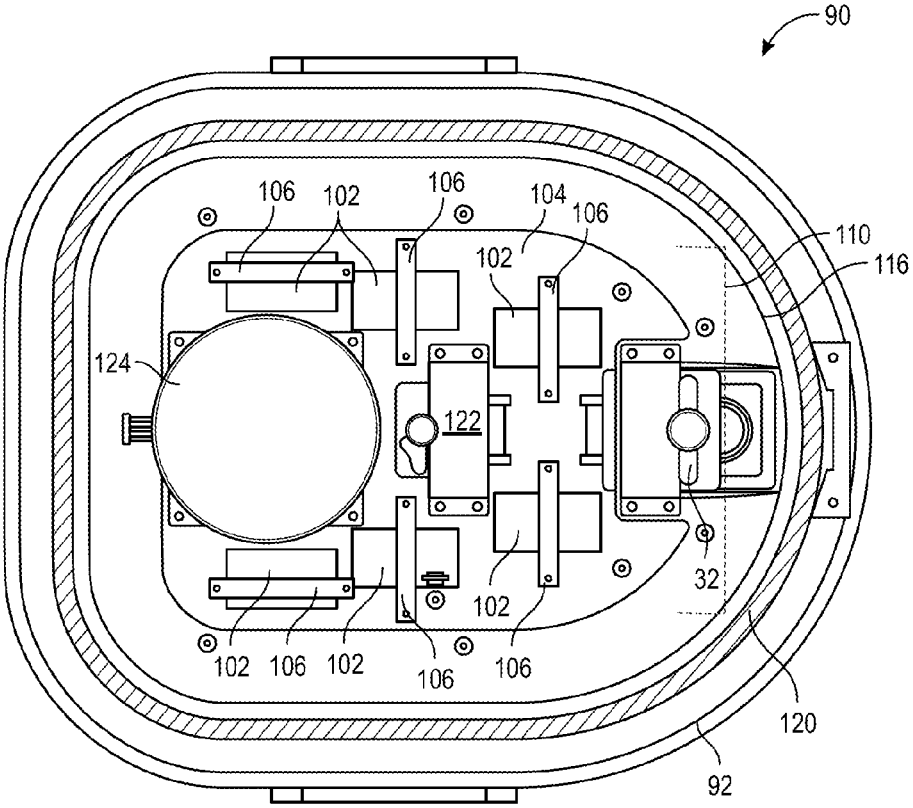
FIG. 9 is a bottom perspective view of the soaking basin of FIG. 7, depicting the heating assembly having PTC heating units with aluminum casings attached to a thin aluminum heat sink plate by brackets.

With reference now to FIGS. 8 and 9, the bottom of the soaking basin 90 is shown. Encased within the base compartment 116 of the base unit 92 is the heating assembly 110 shown in FIG. 9. The heating assembly 110 consists of six PTC type heating units 102 attached to a thin aluminum heat sink plate 104. Each PTC type heating unit 102 is secured to the aluminum heat sink plate 104 via an aluminum bracket 106. The aluminum heat sink plate 104 is mounted to the bottom of the base unit 92. The heat sink plate 104 contacts the base unit 92 in order to transfer heat uniformly to the base unit 92 and then to the therapeutic liquid contained in the disposable liner 96 within the support frame 94. A vibration unit 128 is also disposed in the basin compartment.

The heating assembly 110 further includes one or more bands of flexible heating elements (plates) 120, disposed about the peripheral wall 93 of the base unit 92 and act as auxiliary heating elements. The thin aluminum heat sink plate 104 transfers the heat from the PTC heating units 102 uniformly to the plastic footbath base unit 92. This embodiment includes an electronic circuit 130 to control the heat level of the PTC heating units 102 and the bands of flexible heating plates 120.

The heating assembly 110 is configured to melt paraffin wax to provide a therapeutic soak. The bath base's 92 maximum temperature setting should be over 60 Celsius in order to melt wax in the case where paraffin is used as the therapeutic liquid. The paraffin wax's melting point is generally no higher than 55 Celsius. The heat transferred from the aluminum heat sink plate 104 to the plastic portion of the base unit 92 will be high and the bath base 92 plastic's temperature rating should be safe for 120 Celsius or higher. In this manner, the basin can provide a soak with paraffin bath in a vibrating basin via the vibration unit 128.

The present invention has been described above in terms of presently preferred embodiments so that an understanding of the present invention can be conveyed. However, there are other embodiments not specifically described herein for which the present invention is applicable. Therefore, the present invention should not to be seen as limited to the forms shown, which is to be considered illustrative rather than restrictive.

What is claimed is:

1. A portable soaking basin, comprising:

a base unit having a basin base and a peripheral basin wall adjacent to and projecting upwardly from the basin base;

a basin floor above the basin base as to create a basin cavity sized to receive a user's feet above the basin floor and a base compartment below the basin floor;

a disposable liner sized to nest within the basin cavity and configured to hold a soaking solution, the liner including a floor and a lip disposed about a periphery of an upper end of the liner;

a frame sized to be nested between the base unit and the disposable liner, the frame defining a plurality of voids throughout such that the frame is incapable of holding the soaking solution apart from the disposable liner; and a magnetic jet assembly having a magnetic drive assembly disposed within the base compartment and an impeller assembly removably disposed within the basin cavity on an opposing side of a basin wall relative to the magnetic drive assembly, the impeller assembly includes an impeller housing that defines input ports disposed in an upper portion of the housing and circumscribes the shaft, the impeller assembly operatively coupled to the magnetic drive assembly only via magnetic attraction, wherein the basin floor is disposed between the impeller assembly and the magnetic drive assembly.

2. The soaking basin as defined in claim 1, wherein the disposable liner is of a pre-formed shape.

3. The soaking basin as defined in claim 1, further comprising a heating assembly having a plurality of heating elements coupled to heat sink plate attached to the basin floor and having a flexible band of heating elements disposed about the basin wall.

4. The soaking basin as defined in claim 1, wherein the impeller assembly is positioned atop a raised planar portion of floor and elevates the impeller assembly relative to a plurality of parallel ridges.

5. The soaking basin as defined in claim 1, wherein the impeller assembly includes an impeller mounted for rotation within the impeller housing, the impeller having a cylindrical shaft, a planar base centered on the shaft, and a plurality of fins extending outwardly from the shaft, the planar base having a top side and bottom side, the plurality of fins disposed on the top side, the impeller further having a magnetic component disposed on a bottom of the impeller.

6. The soaking basin as defined in claim 5, wherein the shaft is affixed to the housing and defines an axis of rotation (Ar) oriented transverse to the basin floor.

7. The soaking basin as defined in claim 5, wherein the impeller housing of the impeller assembly defines a bottom opening that has a greater diameter than the diameter of the impeller.

8. The soaking basin as defined in claim 5, wherein the magnetic drive assembly includes a planar disc that is disposed below the impeller assembly and projects a magnetic field that magnetically attracts the impeller assembly to secure the impeller assembly in place.

9. The soaking basin as defined in claim 5, wherein the impeller housing includes an output port that is distally spaced from the impeller.

10. The soaking basin as defined in claim 9, wherein the output port is defined by a projection of the housing that is oriented tangential to the impeller.

11. The soaking basin as defined in claim 10, wherein the magnetic drive assembly is an electro-magnet that generates the magnetic field to cause the impeller to spin about the axis of rotation, when in use.

12. A portable soaking basin, comprising:

a base unit having a basin base and a peripheral basin wall adjacent to and projecting upwardly from the basin base, a basin floor above the basin base as to create a basin cavity sized to receive a user's feet above the basin floor and a component compartment below the basin floor;

a disposable liner sized to nest within the basin cavity and configured to hold a soaking solution, the liner including a floor and a lip disposed about a periphery of an upper end of the liner;

a magnetic drive assembly disposed within the component compartment; and an impeller assembly removably disposed within the basin cavity on an opposing side of a basin wall relative to the magnetic drive assembly, the impeller assembly operatively coupled to the magnetic drive assembly only via magnetic attraction,) the impeller assembly includes an impeller housing that defines input ports disposed in an upper portion of the housing and circumscribes the shaft and an output port that is distally spaced from the impeller and is defined by a projection of the housing that is oriented tangential to the impeller, and an impeller mounted for rotation within the impeller housing, the impeller having a cylindrical shaft, a planar base centered on the shaft, and a plurality of fins extending outwardly from the shaft, the planar base having a top side and bottom side, the plurality of fins disposed on the top side, the impeller further having a magnetic component disposed on a bottom of the impeller.

13. The soaking basin as defined in claim 12, wherein the impeller housing of the impeller assembly defines a bottom opening that has a greater diameter than the diameter of the impeller.

14. The soaking basin as defined in claim 12, wherein the magnetic drive assembly includes a planar disc that is disposed below the impeller assembly and projects a magnetic field that magnetically attracts the impeller assembly to secure the impeller assembly in place.

15. The soaking basin as defined in claim 14, wherein the magnetic drive assembly is an electro-magnet that generates the magnetic field to clause the impeller to spin about the axis of rotation, when in use.

16. A portable soaking basin, comprising:

a portable base unit having a basin base and a peripheral basin wall adjacent to and projecting upwardly from the basin base;

a basin floor above the basin base as to create a basin cavity sized to receive a user's feet above the basin floor and a base compartment below the basin floor;

a heating assembly having a plurality of heating elements coupled to heat sink plate attached to the basin floor and having a flexible band of heating elements disposed about the basin wall, the heating assembly configure to melt paraffin wax; and a magnetic jet assembly having a magnetic drive assembly disposed within the base compartment and an impeller assembly removably disposed within the basin cavity on an opposing side of a basin wall relative to the magnetic drive assembly, the impeller assembly includes an impeller housing that defines input ports disposed in an upper portion of the housing and circumscribes the shaft, the impeller assembly operatively coupled to the magnetic drive assembly only via magnetic attraction, wherein the basin floor is disposed between the impeller assembly and the magnetic drive assembly.

17. The soaking basin as defined in claim 16, further comprising a vibration assembly mounted in the base compartment to vibrate fluid the basin cavity.

18. The soaking basin as defined in claim 16, wherein the impeller assembly includes an impeller mounted for rotation within the impeller housing, the impeller having a cylindrical shaft, a planar base centered on the shaft, and a plurality of fins extending outwardly from the shaft, the planar base having a top side and bottom side, the plurality of fins disposed on the top side, the impeller further having a magnetic component disposed on a bottom of the impeller.

19. The soaking basin as defined in claim 18, wherein the impeller housing of the impeller assembly defines a bottom opening that has a greater diameter than the diameter of the impeller.

20. The soaking basin as defined in claim 19, wherein the impeller housing includes an output port that is distally spaced from the impeller.

* * * * *